United States Patent [19]

Wilkie

[11] 4,290,378

[45] Sep. 22, 1981

[54] TWISTED SINGLES CARPET YARN

[75] Inventor: Arnold E. Wilkie, Pensacola Beach, Fla.

[73] Assignee: Monsanto Company, St. Louis, Mo.

[21] Appl. No.: 71,460

[22] Filed: Aug. 31, 1979

[51] Int. Cl.[3] ..... D02J 1/08

[52] U.S. Cl. ..... 112/410; 28/220; 57/246; 57/282; 57/350

[58] Field of Search ..... 57/58, 59, 243, 246, 57/247, 282, 289, 290, 350, 351, 908; 28/220, 247, 271-276; 112/410

[56] References Cited

U.S. PATENT DOCUMENTS

| | | | |
|---|---|---|---|
| 2,961,010 | 11/1960 | Berry | 57/206 X |
| 2,985,995 | 5/1961 | Bunting et al. | 57/908 X |
| 3,069,836 | 12/1962 | Dahlstrom et al. | 57/908 X |
| 3,457,610 | 6/1969 | Williams et al. | 57/908 X |
| 3,483,691 | 12/1969 | Williams et al. | 57/908 X |
| 3,537,248 | 11/1970 | Berg et al. | 57/908 X |
| 3,745,617 | 7/1973 | Smith | 28/220 X |
| 3,968,638 | 7/1976 | Lafayette et al. | 57/247 |
| 4,207,730 | 6/1980 | Lorenz | 57/351 |

*Primary Examiner*—Donald Watkins
*Attorney, Agent, or Firm*—John W. Whisler

[57] ABSTRACT

A bulky, heatset, tangle, twisted singles yarn is provided having exceptional column strength and resistance to bending and untwisting. Cut pile produced therefrom has excellent tuft rigidity and endpoint definition. The yarn is produced by passing a bulked, twisted singles yarn through a chamber wherein the yarn is tangled and heatset with a heated fluid such as steam.

23 Claims, 9 Drawing Figures

TWISTED SINGLES CARPET YARN

BACKGROUND OF THE INVENTION

A. Field of the Invention

This invention relates to novel singles yarn and its production, and is more particularly concerned with improved singles yarn for use as pile in pile fabrics, especially cut pile carpets.

B. Description of the Prior Art

Over 500 million square yards or 418 million square meters of cut pile carpeting are now being produced annually most of which is produced from nylon. With present technology to achieve cut pile with acceptable aesthetics requires a torque balanced two-ply heatset yarn. However, it would be highly desirable to use a twisted heatset singles yarn since it is usually less expensive to produce a large denier singles yarn rather than the two yarns required to form a plied yarn of the same denier. Also, it is cheaper to twist a singles yarn than to form a plied yarn. Additionally, to have both a singles and plied yarn would offer fabric designers more flexibility. Unfortunately, unless a singles yarn is highly twisted, cut pile prepared therefrom lacks tuft rigidity (i.e. the tufts lack bending resistance and column strength) and consequently will not stand up. Also, the cut pile lacks end point definition because the tufts tend to expand, balloon and untwist until they become snarled with neighboring tufts, giving the pile a matted appearance wherein the individual tufts become undistinguishable. On the other hand, highly twisted singles yarns are torque lively thereby causing difficulties in commercial heatsetting processes. Moreover, the torque liveliness of the highly twisted singles yarn is not removed by commercial heatsetting processes and, therefore, the yarn must be processed at high tensions to avoid kinks which would obstruct delivery tubes and needles of tufting machines. And, even if the highly twisted, torque lively, singles yarn were processed into cut pile, the resulting tufts would tend to be non-uniform, lack bulk, untwist and generally provide a cut pile having poor aesthetics.

U.S. Pat. No. 3,968,638 describes a singles yarn for cut pile consisting of a highly entangled, textured singles yarn to which a latent false twist has been imparted. The latent crimp and twist are developed by heat and moisture after tufting such as in the dyeing or finishing operations. However, cut pile produced from this yarn lacks desired aesthetic characteristics of plied heatest yarn, and therefore, has not enjoyed commercial success.

Presently, singles carpet yarns are used to produce level loop pile for commercial applications where durability and low cost rather than aesthetics are of primary importance. Singles yarn used in level loop pile is not twisted and therefore is also not heatset, thereby saving the cost of these yarn processing operations. However, for some commercial carpeting applications, such as libraries, offices, etc., it would be highly desirable to provide an attractive cut pile at a price competitive with level loop pile carpeting.

SUMMARY OF THE INVENTION

According to one aspect of the invention, there is provided a bulky, loopy, heatset, tangled, twisted singles yarn. The yarn is characterized in that the tangle is imparted to the yarn after the twist is inserted and as the yarn is being heatest. The yarn is further characterized in having a bundle twist of 0.50 to 6 turns per inch, preferably, 1 to 6 turns per inch and a lateral coherency of 1 to 15 cm, preferably, 2 to 8 cm, when tested as hereinafter defined.

The singles yarn of this invention has exceptional column strength and resistance to bending and untwisting and provides cut pile having exceptional tuft rigidity, end point definition, compression resistance, resilience and wear resistance. The tufts stand up like "soldiers on parade" and when viewed from above the cut pile has the appearance of a "room full of BB's", qualities heretofore obtainable only with cut pile produced from two poly heatset yarn. In comparison, singles yarn processed using conventional mill technology (i.e. cablers or twisters and batch autoclave or continuous heatsetting equipment) lacks column strength and bending resistance and cut pile produced therefrom tends to lie down, balloon and untwist, and in general, has poor end point definition.

The singles yarn of the present invention differs from heretofore produced singles yarn in that it is tangled after being twisted, for example, while being heatset. The tangle in the yarn locks the twist in the yarn (i.e. imparts "twist-lock" thereto) and significantly reduces the tendency of the yarn to untwist, balloon and expand in cut pile and thereby imparts exceptional end point definition to cut pile produced from the yarn. The tangle in the yarn also serves to cross-brace the filament bundle so that the tufts of cut pile produced therefrom stand up and have exceptional bending resistance, compression resistance, and tuft rigidity (i.e. column strength).

According to another aspect of the invention there is provided a novel heatsetting process (referred to herein as "jet-set" process) for producing the singles yarn of this invention wherein a feed yarn consisting of a bulked yarn to which has been imparted a bundle twist of 0.5 to 6 tpi is continuously fed at an overfeed of 10 to 50% through an open-ended chamber, such as a tube, having at or near its yarn inlet end at least one jet of heated fluid (preferably steam) which impinges against the yarn whereby filaments on the outside of the twisted bundle are entangled with filaments on the inside of the twisted bundle through the length of the yarn. Preferably, the yarn in passing through the chamber is under a slight tension sufficient to facilitate handling of the yarn. The tension is easily controlled by adjusting the velocity of the jet of heated fluid and/or overfeed. The entangled filaments serve structurally to cross-brace the yarn, in that, the resulting entanglements tend to traverse the long axis of the yarn. In passing through the chamber the yarn is in intimate contact with high velocity heated fluid for a period of time sufficient to achieve desired setting of the twist in the yarn. Under such conditions latent bulk, if present, will also be developed. The chamber passage is filled with and may also be jacketed by heated fluid. The yarn upon exiting the chamber is ready for tufting. Normally, surface loops are created by the jet action. These loops are believed to contribute to the tuft rigidity of cut pile produced therefrom since they contact neighboring tufts and tend to increase tuft density or packing of the tufts. The bulked feed yarn is composed of textured (e.g. crimped) filaments or staple fibers.

The texture (i.g. crimp) may be imparted to the filaments or fibers by any suitable means such as by processes described and/or employed in the texturing art such as by hot-jet crimping, stuffer-box crimping, gear-crimping, etc. or by use of appropriate bicomponent filaments or by spinning techniques. A particularly useful process is the draw-texture process described in U.S. Pat. No. 3,457,610 in which continuous filament yarn is drawn and bulked. Normally, bulked continuous filament (BCF) yarn producer imparts a slight twist and/or tangle to the yarn to give it coherency during subsequent processing. Twist is then imparted to the BCF yarn and may be accomplished using conventional twisting equipment such as a cabler or ring twister. The continuous filament yarn after being bulked but before being twisted will usually have a latent or potential bulk of between 10 and 50% when tested as hereinafter described.

The feed yarn may be composed of either staple fibers or continuous filaments of polymeric materials which are capable of being heatest such as polyamides, polyesters, polyolefins and polyacrylonitrile copolymers and will normally have a denier between 500 and 5000 with a denier per filament (dpf) between 6 and 40. Of course, the feed yarn may be of a higher or lower denier or dpf, if desired. Suitable polymeric materials include nylon 6, nylon 66, polyesters, such as polyethylene terephthalate and the like which are thermoplastic at least in their crimping and twisting behavior.

While the yarns of the present invention are particularly useful for providing cut pile carpet contructions, they may be used for providing loop pile carpet constructions or in providing other pile fabrics or textile fabrics.

The jet-set process used to provide the singles yarn of the invention offers several significant processing advantages over present carpet mill heatsetting technology, i.e. conventional batch autoclave and continuous heatsetting technology. In the first place, the heat-setting apparatus of the jet-set process typically occupies a space of only about 0.03 $ft^3$ ($8.4\times10^{-4}$ $M^3$), whereas that of the batch autoclave process typically occupies about 422.5 $ft^3$ (11.8 $M^3$) and that of the continuous process about 4920 $ft^3$ (137.8 $M^3$). Secondly, the conventional processes are more labor intensified than the jet-set process. Thirdly, the initial cost of the jet-set heatsetting equipment is less than that of the conventional heatsetting equipment.

In addition to processing advantages, the jet-set process also offers important product advantages over the conventional processes, the most important of which, is that, the jet-set process provides yarn from which pile having significantly better dye uniformity (i.e. dyed to a uniform shade of color without streaks) is obtained. Dye non-uniformity in cut pile normally results from there being variations in the pile yarn, particularly, variations in bulk, modification ratio of the filament cross-section, endpoint definition and thermal history. As a practical matter, it is not possible in texturing operations to provide a plurality of yarns each having the same level of crimp, that is, there are variations in crimp from one texturing position to the next and from machine to machine. In conventional heatsetting operations where the yarns are processed under conditions of zero tension, these crimp variations result in variations in bulk from yarn to yarn. In the jet-set process, however, the yarns are processed under conditions of controlled tension so that each yarn will bulk to substantially the same level. The tension is conveniently controlled by controlling the overfeed. As bulk is developed in the yarn, the yarn contracts and the amount of this contraction is limited by the overfeed, that is, when the yarn no longer can contract, no further significant bulk is developed. Also, in the jet-set process modification ratio (MR) variations are minimized since the tangle interrupts filament parallelism. Further, cut pile tufts produced from jet-set yarn impart better endpoint definition than cut pile produced from corresponding yarn heatset by conventional processes and, thereby, are most resistant to untwisting and flaring which cause non-uniformity in color appearance; the flared tuft ends where dyed appear to be of a darker shade than ends which have not flared. Finally, the thermal history of each end is substantially the same in the jet-set process, whereas in the conventional processes the yarn, even though processed at the same time, have different thermal histories due to temperature variations within the various heatsetting chambers. Additionally, yarn heatset by conventional heatsetting processes is exposed to high temperatures for relatively long periods of time which can subsequently cause dye uniformity difficulties. For example, the exposure time in the batch autoclave process is 20 to 30 minutes and in some continuous processes in excess of 3 minutes as compared to only a fraction of a second in the jet-set process. Also, in the conventional processes the yarn is merely setting in an atmosphere of steam, whereas in the jet-set process the yarn is in intimate contact with high velocity steam which permits the steam to penetrate the yarn.

According to yet another aspect of the invention, there is provided a pile fabric and, in particular, a cut pile carpet, the tufts of which are formed of the singles yarn of the invention.

According to still another aspect of the invention, there is provided a continuous process for in-line twisting and heatsetting of singles feed yarn of the type described hereinbefore. The small geometry of the jet-set heatsetting apparatus and the continuous nature of the jet-set process permit the apparatus to be coupled in-line with 2 for 1 twisting equipment and/or other processing equipment. Normally, yarn is processed through a 2 for 1 twister at take-off speeds of up to 125 yds. (114.3 m) per minute. According to this aspect of the invention the yarn is preferably continuously withdrawn from the 2 for 1 twister at a yarn speed ranging from 50 ;l to 125 ypm and fed directly through the jet-set apparatus. The distance between the twister and jet-set apparatus is not important and may be selected to accommodate available space. There are many obvious advantages to this aspect of the invention, such as, both operations now require very little space and time since the heatsetting operation can be operated in-line at the same yarn speed as the twisting operation. Additionally, only one operator is required for the in-line operation.

DETAILED DESCRIPTION OF THE INVENTION

Figure 1:
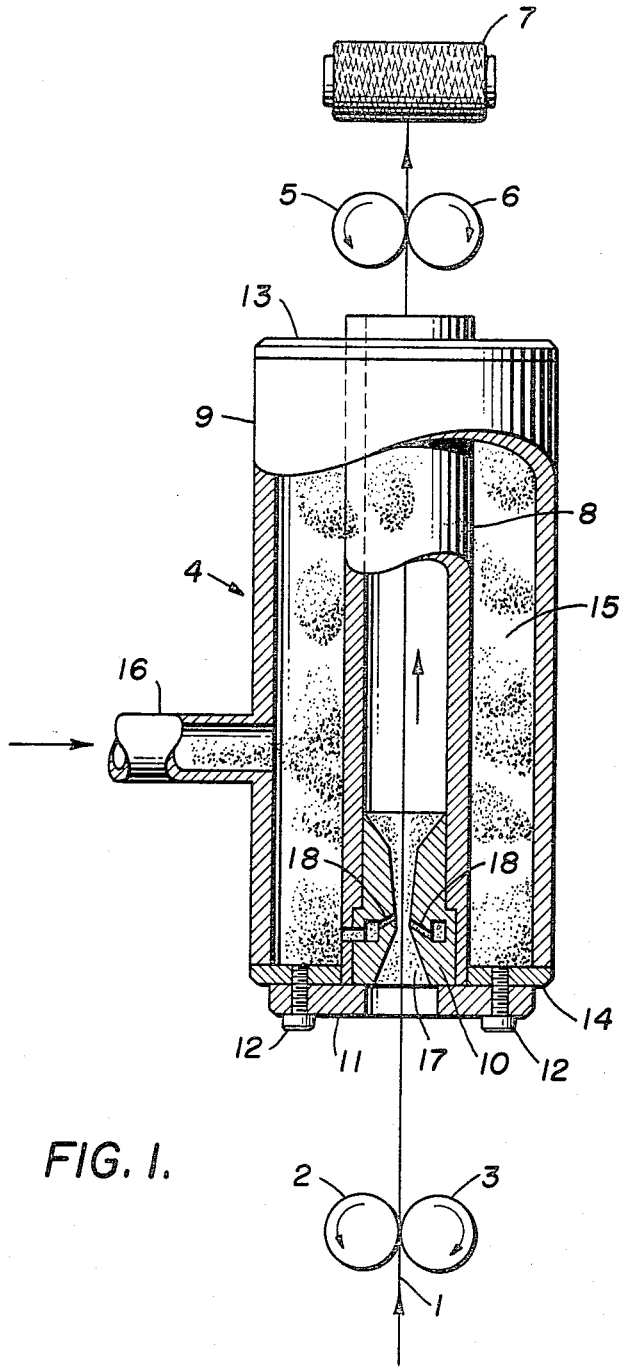
FIG. 1 is a schematic of an apparatus arrrangement suitable for use in preparing the singles yarn of this invention.

In a preferred embodiment of the invention disclosed in FIG. 1, feed yarn 1, having twist and latent crimp, is fed from a suitable source (not shown), such as from a cabler, two-for-one twister or package, between driven roll 2 and its associated idler cot roll 3, through device 4, between driven roll 5 and its associated idler cot roll 6 and, finally wound on to a take-up roll to form package 7. Roll 2 is driven at a higher peripheral speed than roll 5 so as to provide a 10% to 50% overfeed.

Device 4 comprises an inner tubular member 8, an outer tubular member 9 and a replaceable jet nozzle 10 sealably positioned within member 8 at the yarn inlet end of device 4 by means of follower ring 11 held by cap screws 12. Members 8 and 9 are connected at the yarn inlet end and yarn outlet and by shoulders 14 and 13, respectively, thereby defining annular space 15 which jackets tubular member 8. A heated fluid under pressure is supplied to annual space 15 via conduit 16. Jet nozzle 10 has a bore 17 through which yarn 1 passes and which has three sections, a converging frusto-conical inlet section, a diverging frusto-conical outlet section, and a diverging frusto-conical middle section that joins said inlet and outlet sections. Preferably, at least two ports 18 are spaced apart along the axis of the jet nozzle and spaced circumferentially about the axis connect space 15 and middle bore section. Each port 18 and the middle bore section define an acute angle. Normally, this angle will be between 5° C. and 80° C.

Yarn 1 passes through device 4 via follower ring 11, bore 17 and, finally, into and through member 8. Superheated steam (or other heated fluid) passes from space 15 through ports 18 and impinges laterally against yarn 1 within bore 17 at an angle sufficient to forward the yarn into device 4 and at a velocity sufficient to achieve a desired level of tangle. During processing of the yarn bore 17 is filled with steam and tubular member 8 is filled with and jacketed by steam, thereby providing within tubular member 8 an environment in which the twist is capable of being set in the yarn and latent crimp (bulk) developed. For a given set of processing conditions (e.g. heated fluid selection, heated fluid pressure and temperature, yarn speed, denier of yarn, etc.), tubular member 8 must be of a length sufficient to allow adequate time for significant twist setting and crimp development to occur. Normally, with yarn inlet speeds of up to 100 ypm a tubular member length between 10 and 50 cm is more than sufficient to allow adequate time to set the twist in the yarn. It has been found that making tubular member 8 longer than necessary has little effect. Of course, speeds in excess of 100 ypm may suitably be used by selecting appropriate processing conditions.

Processing conditions or factors which have some influence on the tangle level imparted to the yarn are: velocity at which the jet of steam impinges against the yarn, temperature of the steam, yarn speed, total denier and denier per filament of the yarn, composition of the yarn, modification ratio of the yarn, bulk of the yarn, shrinkage of the yarn, finish applied to the yarn and overfeed. Normally, except for the velocity of the steam and overfeed, the other conditions or factors are fixed for a given process. In general, it is desirable to operate the process at an overfeed which is as high as practical, that is, as high as possible while still maintaining continuous and smooth processing of the yarn. The tangle level can then be adjusted by adjusting the steam pressure which in turn changes the velocity of the steam. Several adjustments of the overfeed and steam velocity may be required to attain the desired tangle level and highest practical overfeed. While it is preferred to use steam as the heated fluid, heated air or some other heated fluid such as heated nitrogen or carbon dioxide may be used.

It will be appreciated that, if desired, the entire embodiment shown in FIG. 1 could be inverted so that the yarn would be traveling in a downward instead of upward direction.

Devices particularly useful in carrying out the jet-set process of this invention are described, although not for the purpose of heatsetting, in U.S. Pat. No. 3,457,610 and U.S. Pat. No. 3,745,617. The jet nozzles described in these patents may be replaced with other suitable nozzles. A particularly preferred nozzle for use with the invention is that described in U.S. Pat. No. 3,609,834. Accordingly, the disclosures of the three above-mentioned patents are incorporated herein by reference.

TESTS

(a) Bulk

The term "% bulk" as used herein is determined by the following test: A sample of yarn is placed under sufficient tension to fully extend the yarn (straighten out any crimp) without stretching or elongating the filaments. The length of the yarn in this condition is measured and recorded as $L_1$. The yarn is then subjected to 180° C. dry heat for five minutes and cooled for 60 seconds under no tension, and then after having been cooled for an additional 30 seconds under a tension of 0.009 grams per denier its length is again measured. This latter measured length is recorded as $L_2$. The % bulk is then determined by the following formula: $\% \text{ Bulk} = (L_1 - L_2/L_1) \times 100$.

(b) Lateral Coherency

The term "lateral coherency" as used herein is determined by the following test: A test yarn at least equal in length to the distance between the pair of pendulums mentioned below is vertically suspended from a clamp with a 50 gram weight attached to its lower end, until the weight comes to rest (no longer rotates). Then, without allowing either end of the yarn to rotate, the yarn is horizontally suspended between a pair of rigid pendulums by means of two opposing clamps, one attached to the lower end of each pendulum, the pendulums being at least 50 cm apart and free to swing in the same plane. The length of each pendulum should be equal to one half the distance between the pendulums. With the yarn clamped between the two pendulums, two hooks one above the other are then placed in about the center of the yarn bundle to separate it into two groups of filaments. The upper hook remains stationary during testing. A 500 grams weight is attached to the lower hook and the weight is permitted to pull the two groups of filaments apart. As the hooks move apart in the vertical direction, the clamps move toward each other in the horizontal direction. When the weight comes to rest, the distance in centimeters (cm) is measured. The average of twelve determinations, expressed in centimeters, is taken as the lateral coherency.

(c) Thermal Mechanical Analysis (TMA)

A 10 mm yarn sample is hung in an oven by attaching its upper end to a fixed clamp. The lower end of the sample is attached to the core of a linear differential voltage transformer (LDVT). The core weighs 15 g. The oven is then heated at the rate of 20° C. per minute. The temperature is measured with a thermocouple. The LDVT measures changes in the length of the yarn sample (i.e. shrinkage). During the test, a recorder prints out a curve which is a plot of changes in yarn length (y-axis) against changes in temperature (x-axis). Heatset yarns provide a generally flat curve in the 100° C. to 200° C. range indicating that little or no shrinkage of the yarn occurs in this range. On the other hand, yarns which have not been heatset have significant shrinkage in the 100° C. to 200° C. range.

(d) Compression Resistance

The term "compression resistance" as used herein is determined by the following test in which a 15.24 cm × 15.24 cm sample of carpet is subjected to compression using an Instron® Apparatus, Model TM (manufactured by Instron Corp. of Canton, Mass.). The carpet sample is fastened to an aluminum plate with double-sided tape and then the pile is first hand fluffed and smoothed and then vacuumed so that the tufts stand as upright as possible. Then without disturbing the carpet tufts in any way, the carpet/aluminum plate assembly is placed on the Instron compression table, carpet up. An 80 $cm^2$, round, flat foot is forced into the carpet from above at the rate of 1 cm/min. while recording the force in grams on the foot versus foot movement in mm. The compressed tuft height at a force of 4000 g (i.e. 50 $g/cm^2$), expressed as a percent of the of the original pile height (Ho), is determined by the formula $\% = (Hc/H_o) \times 100$, where Hc is the compressed tuft height in mm ($Hc = Ho - d$, where d is the distance in mm the foot moved in going from no force to a force of 50 $grams/cm^2$). The average of twelve determinations is taken as the % compression resistance. The higher the % compression resistance, the firmer the carpet.

Figure 5:
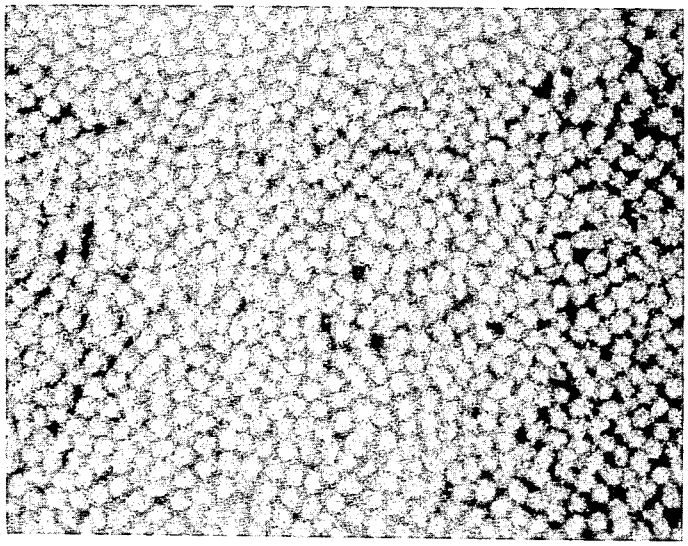
FIG. 5 is a photograph of a cut-pile carpet (viewed from above), the tufts of which are made from the singles yarn shown in FIG. 3.

The following examples are given to further illustrate the invention. In the examples an apparatus arrangement substantially as shown in FIG. 1 was used. Device 4 had an outer tubular member 9 comprised of standard 2.5 inch (6.3 cm) pipe and an inner tubular member 8 comprised of standard 1.5 inch (3.8 cm) pipe having an inside diameter of 0.75 inches (1.9 cm). Member 8 projected 0.5 inch (1.27 cm) beyond the outlet end of member 9. The overall outside diameter of jet nozzle 10 was 0.75 inch and the overall length was 1.327 inch (3.37 cm). The nozzle contained 3 removable waffers as shown in FIG. 5 of U.S. Pat. No. 3,609,834. The converging inlet section of the nozzle bore had a 50° cone angle and converged to a bore diameter of 0.078 inch (2 mm). The middle bore section then diverged at a 15° cone angle and joined the diverging outlet having a 90° cone angle. The center waffer had one slot and the top waffer two slots (conduits) each drilled through the wall of the bore at an angle of 140° with respect to the axis of the bore. The slots in the top waffer were spaced 0.050 inch (1.3 mm) on center and the slot in the center waffer was spaced opposite and equidistant from the slots in the top waffer. The slots in the top waffer each had a depth of 0.040 inch (1.02 mm) and a width of 0.012 inch (0.30 mm). The slot in the center waffer had a depth of 0.030 inch (0.76 mm) and a width of 0.020 inch (0.51 mm). The nozzle was locked into the body assembly as shown in FIG. 1.

The device was mounted about 12 inches (30.48 cm) from a driven feed roll-cot roll combination on a vertical frame. A similar roll combination was located about 10 inches (25.4 cm) above the device and a winder was located below this roll combination. The coupling of the device was connected to a supply of superheated steam by means of pipe with a pressure gauge and steam pressure regulator immediately upstream. The device was thermally insulated with standard-thickness magnesia pipe covering and wrapped with seamed asbestos cloth. The follower ring was left uninsulated and exposed so that the jet nozzle could be easily removed and replaced. Two funnel-mouthed aluminum ducts, one below and one above the device, were each connected to a vacuum source to draw away fumes from the operating area.

EXAMPLE 1

Four bobbins of drawn and crimped yarns (feed yarn) were each threaded through a 2 for 1 twisting apparatus (Verdol Model CD400 manufactured by Verdol, a French Company) in-line with the apparatus shown in FIG. 1 to provide four positions. Each feed yarn was comprised of nylon 66 having a total denier of 3690 and 204 filaments (dpf = 18) of trilobal cross-section (modification ratio or MR = 2.09) and a potential bulk of 22%. The four positions were each operated using superheated steam as the heated fluid under the following conditions:

| | |
|---|---|
| 2 for 1 spindle speed (rpm) | 2900 |
| Lower feed roll speed (ypm/mpm) | 68/62.2 |
| Upper feed roll speed (ypm/mpm) | 50/45.7 |
| Overfeed (%) | 36 |
| Superheated steam pressure (psig/newton per $m^2$) | $80/6.5 \times 10^5$ |
| Superheated steam temperature (°C.) | 260 |

Figure 3:
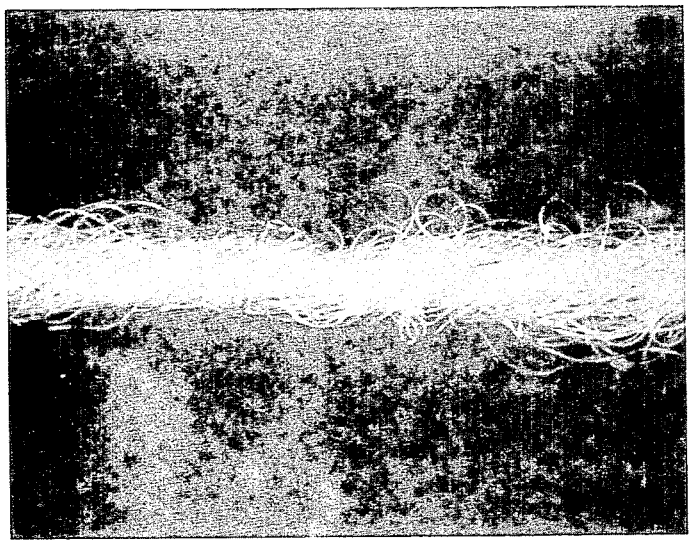
FIG. 3 is a photograph (magnification 8X) of a twisted singles yarn (viewed from the side) heatset by the jet-set process of the present invention.

The resulting tangled twisted heatset yarns had an average denier of 4197, 2.8 tpi (110 tmp) of Z twist and a lateral coherency of 4.85 cm. Each yarn had exceptional column strength and resisted untwisting and bending. TMA showed each of the yarns to have no significant shrinkage in the 100° C. to 200° C. range. FIG. 3 is a photograph of one of the yarns taken at a magnification of 8X.

Figure 8:
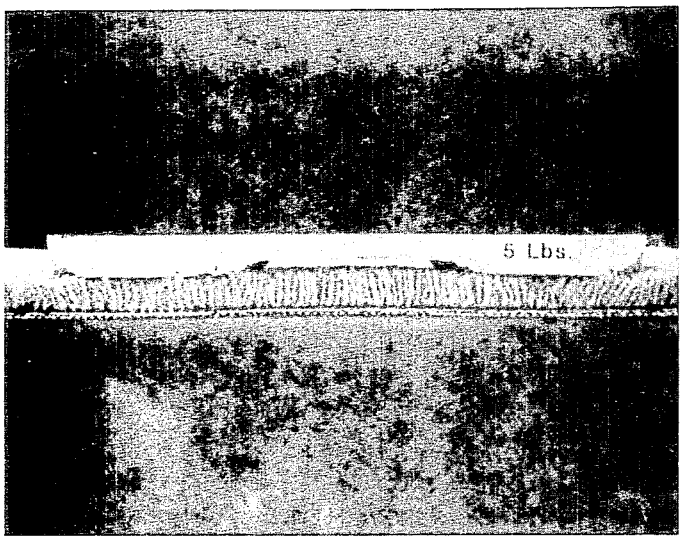
FIG. 8 is a photograph taken from the side of the carpet shown in FIG. 5 with a 5 lb. weight placed on its pile.
Figure 9:
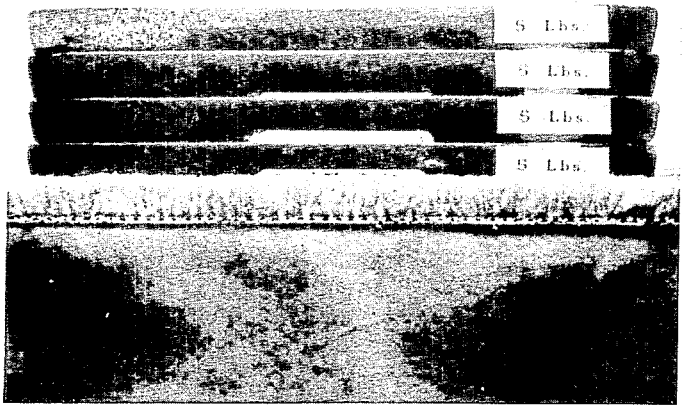
FIG. 9 is a photograph taken from the side of the carpet shown in FIG. 5 with a stack of four 5 lb. weights placed on its pile.

The yarns were randomly tufted to make a 35 oz./$yd^2$ (1.2 $kg/m^2$), 24-inch (61-cm) wide cut pile carpet sample having a finished pile height of ½ inch (19.05 mm) using a Singer 3/16-inch (4.76 mm) gauge tufting machine and 7 stitches per inch (27.6 stitches per 10 cm). A Typar backing was used. (Typar is a trademark of duPont for a spunbonded polyester fabric backing). The carpet sample was beck dyed with acid dyes. The dyed carpet sample was evenly dyed, streak-free, of uniform pile height and of generally uniform appearance indicating no differences in yarn uniformity from position to position. The tufts stood upright (possessed exceptional rigidity) and, when viewed from above, each individual cut, twisted tuft end was distinguishable from neighboring ends (possessed outstanding endpoint definition). The carpet had excellent resilience and a compression resistance value of 63.06%. FIG. 5 is a photograph of the carpet sample taken from overhead and shows the exceptional end point definition, body and cover of the carpet. FIG. 8 is a photograph taken from the side of the carpet after a 5-lb (2.3 kg) weight had been carefully placed on its pile. The weight is shaped like a dumbell or shoe, that is, each end of the weight contacts the carpeting and there is a space in between which does not. This space is clearly visible in FIG. 8, showing that the carpet piling is supporting the weight. The exceptional tuft rigidity, compression resistance and column strength of the carpet pile is dramatically demonstrated in FIG. 9 which shows a stack of four 5-lb weights resting on the carpet pile. The space between the ends of the weight is still clearly visible.

EXAMPLE 2

In this example, six feed yarns identical to those described in Example 1 were heatset using commercially available continuous heatsetting equipment (equipment manufactured by Superba). The yarns were extremely difficult to process through this equipment due to their twist liveliness. In processing the yarns the following conditions were used:

| | |
|---|---|
| Number of ends | 6 |
| Belt Speed (m/min) | 3.3 |
| Bulking chamber temp (°C.) | 9.6 ± 2 |
| Entry barrier Temp (°C.) | 60 ± 5 |
| Heatsetting chamber temp (°C.) | 138 ± 1 |
| Heatsetting chamber pressures (bars/-newtons per $m^2$) | $2.7/2.7 \pm 10^5$ |
| Exit barrier temp (°C.) | 50 ± 5 |
| Dryer temp (°C.) | 70 to 75 |
| Dimensions of chamber (approximate) | |
| length (ft/m) | 75/22.9 |
| width (ft/m) | 11/3.4 |
| height (ft/m) | 6/1.8 |
| Dwell time per 6 ends (min.) | 6.9 |

Figure 2:
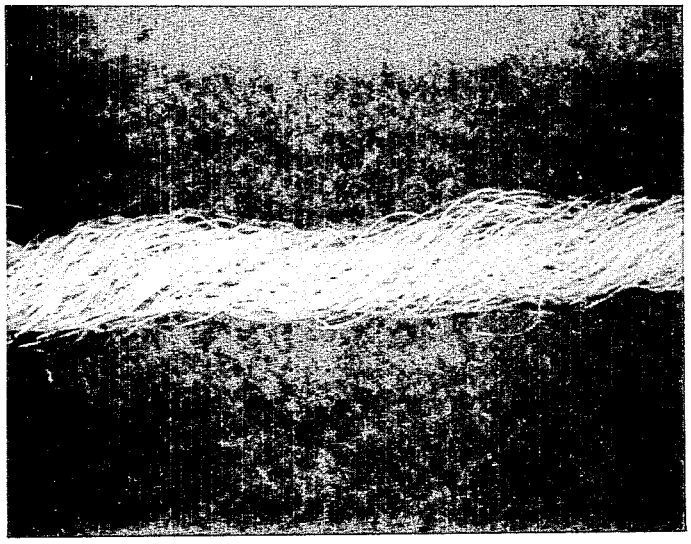
FIG. 2. (prior art)
FIG. 2 is a photograph (magnification 8X) of a twisted singles yarn (viewed from the side) heatset by conventional continuous heatsetting equipment. The yarn is representative of twisted singles yarn heatset by prior art technology.
Figure 4:
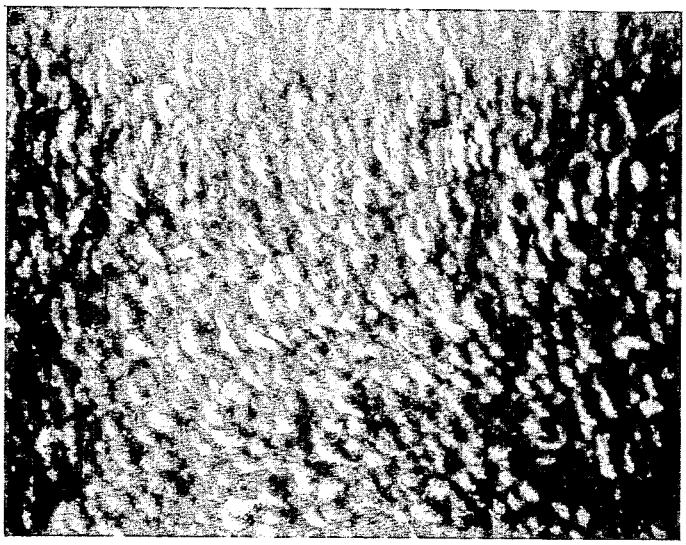
FIG. 4. (prior art)
FIG. 4 is a photograph of a cut-pile carpet (viewed from above), the tufts of which are made from the singles yarn shown in FIG. 2.
Figure 6:
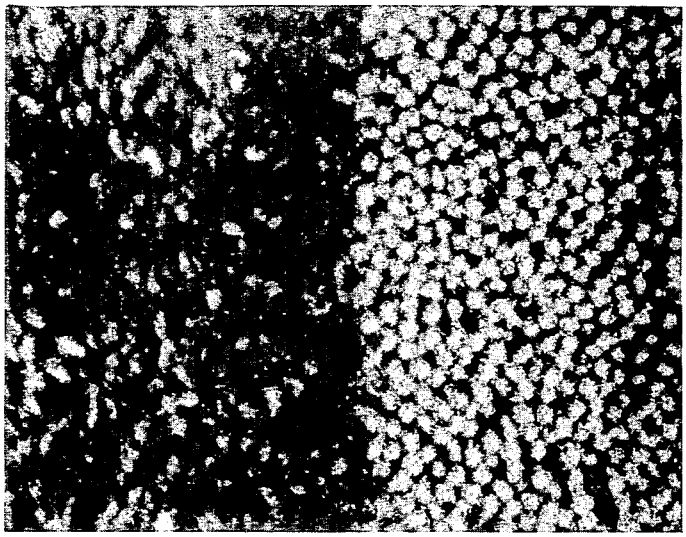
FIG. 6. (prior art)
FIG. 6 is a side-by-side comparison of the photographs shown in FIGS. 4 and 5.
Figure 7:
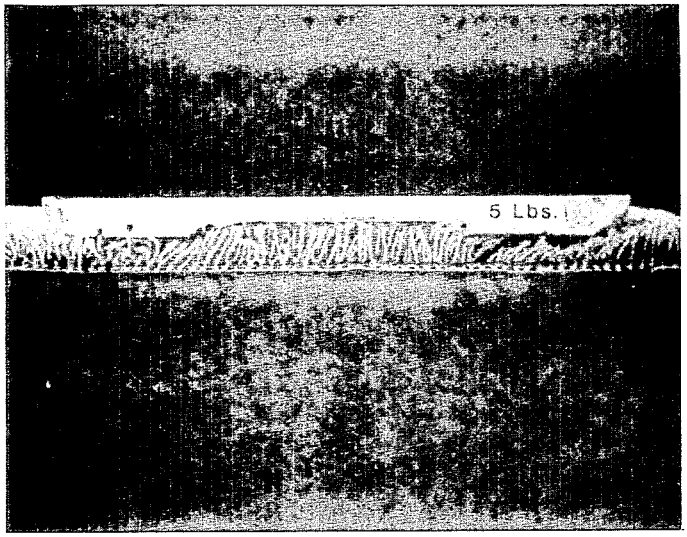
FIG. 7. (prior art)
FIG. 7 is a photograph taken from the side of the carpet shown in FIG. 4 with a 5 lb. weight placed on its pile.

The processed yarns, as compared to the yarns of Example 1, possessed little column strength and less resistance to untwisting and bending. FIG. 2 is a photograph of one of the yarns taken at a magnification of 8X. The yarns were randomly tufted to make a 35 oz/yd$^2$ (1.2 kg/m$^2$) 24-inch (61-cm) wide cut pile carpet sample of the same construction as the carpet sample described in Example 1. The carpet sample lacked both tuft rigidity and endpoint definition. Moreover, the tufts would not stand up and the pile lacked body and cover. The carpet sample had a compression resistance value of 41.31%. The carpet sample was dyed in the same manner as described in Example 1. The dyed sample lacked dye uniformity and, in general, the aesthetics of the carpet were poor. FIG. 4 is a photograph of the carpet sample taken from overhead. FIG. 6 is a photograph showing a side-by-side comparison of the carpet sample of Example 1 (right) and Example 2 (left). FIG. 7 is a photograph taken from the side of the carpet sample after a 5-lb (2.3 kg) weight had been carefully placed on its pile. Before placing the weight, the pile was brushed by hand in an attempt to get the tufts to stand up. In contrast, the tufts of the carpet sample of Example 1 stood up without brushing.

EXAMPLE 3

In this example, a feed yarn identical to that described in Examples 1 and 2 was heatset at 132.2° C. in skein form in a conventional batch autoclave at 270° C. using the following procedure. First, the yarn was made into skeins and the skeins were loaded into a tumbler where live steam at approximately 100° C. was circulated for about 5 minutes. The skeins were then placed in an autoclave and treated with 132.2° C. steam. The autoclave was programmed to go through the heatsetting cycle which took about 30 min. during which time the autoclave was taken through cycles of first being pressured with steam and then being exhausted to atmosphere with the last steam (132.2° C.) cycle being held for about 15 minutes. After autoclaving, the skeins were dried and allowed to equilibrate at ambient conditions. The resulting heatset yarn resembled the continuous heatset yarn of Example 2. The yarn had a lateral coherency of 40.16 cm. TMA showed the yarn to have no significant shrinkage in the 100° C. to 200° C. range. The TMA curves of this yarn and the yarn of Example 1 were almost identical. The yarn was tufted to make a carpet sample of the same construction as carpet samples of Examples 1 and 2. The aesthetics of this carpet sample were similar to those of the carpet sample of Example 2.

EXAMPLE 4

In this example, a feed yarn composed of nylon 66 staple length fibers each of 18 denier and of a triskellion cross-section (MR = 1.68). The yarn was of a 2.5 cotton count size, 9.0 crimps per inch and contained 4.0 tpi (157.5 tpm) of Z-twist. The yarn was heatset using the apparatus and procedure described in Example 1 under the following conditions:

| | |
|---|---|
| Lower feed roll speed (ypm/mpm) | 50/45.7 |
| Upper feed roll speed (ypm/mpm) | 42/38.4 |
| Superheated steam pressure (psig/newton per $m^2$) | $110/8.6 \times 10^5$ |
| Superheated steam temperature (°C.) | 250 |
| Overfeed (%) | 19 |

The resulting heatset yarn had a denier of 4885 and outstanding column strength and resistance to untwisting and bending. The yarn was tufted to make a 36 oz/yd$^2$ (1.2 kg/m$^2$) 24-inch (0.61 m) wide cut pile carpet sample having a finished pile height of ½ inch (12.7 mm) using a Singer 3/16 (4.76 mm) gauge tufting machine and 8.5 stitches per inchs (33.5 stitches per 10 cm). A Typar backing was used and the carpet was dyed as described in Example 1. The carpet sample had excellent tuft rigidity, end point definition, and dyed evenly without streaks.

While the invention has been illustrated using the apparatus shown in FIG. 1, it will be understood that in producing the singles yarn of this invention the crimped and twisted singles feed yarn alternatively may be tangled and then subsequently heatset or vice versa (i.e. heatset and then subsequently tangled). Although the alternative methods of producing the singles yarn of this invention may provide a slightly bulkier yarn, the systems economics dictate using an apparatus of the type shown in FIG. 1 wherein the yarn is virtually simultaneously tangled and heatset.

I claim:

1. A bulky, heatset singles carpet yarn, said yarn having a bundle twist of 0.5 to 6.0 turns per inch (19.7 to 236.2 turns per meter) and sufficient tangle to provide a lateral coherency of 1 to 15 cm, wherein said tangle is imparted to the yarn after said bundle twist.

2. The yarn of claim 1 wherein the lateral coherency is between 2 and 8 cm.

3. The yarn of claim 2 wherein the bundle twist is at least 1.0 turn per inch (39.37 turns per meter).

4. The yarn of claim 2 wherein the yarn is composed of continuous filaments.

5. The yarn of claim 2 wherein the yarn is composed of staple length fibers.

6. The yarn of claim 2 wherein the yarn is composed of polyhexamethylene adipamide.

7. A carpet or rug having a cut pile formed by tufts anchored in a backing, each tuft being formed from a bulky, heatset singles carpet yarn having a bundle twist of 0.5 to 6.0 turns per inch (19.7 to 236.2 turns per meter) and sufficient tangle to provide a lateral coherency of 1 to 15 cm, wherein the tangle has been imparted to the yarn after the twist.

8. The carpet of claim 7 wherein the yarn has a lateral coherency between 2 and 8 cm.

9. The carpet or rug of claim 8 wherein the yarn has a bundle twist of at least 1.0 turns per inch (39.37 turns per meter).

10. The carpet or rug of claim 8 wherein the yarn is composed of continuous filaments.

11. The carpet or rug of claim 8 wherein the yarn is composed of staple length fibers.

12. The carpet or rug of claim 8 wherein the yarn is composed of polyhexamethylene adipamide.

13. A process for heatsetting a bulked, twisted singles yarn having a bundle twist between 0.5 and 6.0 turns per inch (19.7 to 236.2 turns per meter), comprising: passing said singles yarn at an overfeed of from 10 to 50% through an open-ended tubular chamber filled with a heat fluid, wherein at least one jet of heated fluid is directed laterally against the yarn at a velocity sufficient to cause filaments or fibers at the outside of the bundle to entangle with those at the inside of the bundle along the entire length of the yarn, said process being characterized in that the temperature of the heated fluid and the residence time of the yarn in the chamber are correlated to set the twist in the yarn and the overfeed and velocity of said heated fluid are correlated to provide a yarn having a lateral coherency of 1 to 15 cm while imparting a slight tension to the yarn sufficient to facilitate handling of the yarn.

14. The process of claim 13 wherein the lateral coherency is between 2 and 8 cm.

15. The process of claim 14 wherein the heated fluid is superheated steam.

16. The process of claim 14 wherein the yarn has a bundle twist of at least 1.0 turn per inch (39.37 turns per meter).

17. The process of claim 14 wherein the yarn is a continuous filament yarn.

18. The process of claim 14 wherein the yarn is composed of staple length fibers.

19. The process of claim 13 wherein the yarn is composed of polyhexamethylene adipamide.

20. The process of claim 13 wherein three jets of heated fluid are directed against the yarn.

21. The yarn of claim 1 having a total denier ranging from 500 to 5000 and a denier per filament ranging from 6 to 40.

22. The carpet of claim 7 wherein the yarn has a total denier ranging from 500 to 5000 and a denier per filament ranging from 6 to 40.

23. The process of claim 13 wherein the yarn has a total denier ranging from 500 to 5000 and a denier per filament ranging from 6 to 40.

* * * * *